US009879640B2

(12) United States Patent
Dahl et al.

(10) Patent No.: US 9,879,640 B2
(45) Date of Patent: Jan. 30, 2018

(54) EGR DEVICE HAVING DEFLECTOR AND EGR MIXER FOR EGR DEVICE

(71) Applicants: DENSO International America, Inc., Southfield, MI (US); DENSO CORPORATION, Kariya, Aichi-pref. (JP)

(72) Inventors: Jude Dahl, Westland, MI (US); Tadashi Komiyama, Chiryu (JP)

(73) Assignees: DENSO International America Inc., Southfield, MI (US); DENSO CORPORATION, Southfield, MI (US)

( * ) Notice: Subject to any disclaimer, the term of this patent is extended or adjusted under 35 U.S.C. 154(b) by 288 days.

(21) Appl. No.: 14/594,886

(22) Filed: Jan. 12, 2015

(65) Prior Publication Data

US 2016/0201610 A1 Jul. 14, 2016

(51) Int. Cl.

*F02M 25/07* (2006.01)
*F02M 26/19* (2016.01)
*F02M 26/12* (2016.01)

(52) U.S. Cl.

CPC ..... *F02M 26/19* (2016.02); *F02M 26/12* (2016.02)

(58) Field of Classification Search

CPC ..... F02M 26/00; F02M 26/02; F02M 26/12; F02M 26/13; F02M 26/17; F02M 26/19; F02M 26/21; F02M 23/10222; F02M 2026/001; F02D 41/0047; F02D 41/0065; F02B 47/08

USPC ..... 123/568.11, 568.17; 137/625, 625.4

See application file for complete search history.

(56) References Cited

U.S. PATENT DOCUMENTS 2,354,179 A * 7/1944 Blanc ..... F02M 25/00 123/568.17
6,928,993 B2 * 8/2005 Yu ..... F02M 26/19 123/568.17
7,013,880 B2 * 3/2006 Watanuki ..... F02M 26/69 123/568.2
7,140,357 B2 * 11/2006 Wei ..... F02B 29/0425 123/568.17
7,568,340 B2 * 8/2009 Marsal ..... F02M 26/19 123/568.17
8,950,383 B2 * 2/2015 Sperry ..... F02M 21/042 123/527
9,051,902 B2 * 6/2015 Jones ..... F02M 25/0722
2006/0060171 A1 * 3/2006 Liu ..... F02M 35/10222 123/568.17
2007/0039597 A1 * 2/2007 Zukouski ..... F02M 35/10222 123/568.17
2007/0256413 A1 * 11/2007 Marsal ..... F02M 26/05 60/605.2
2012/0180478 A1 7/2012 Johnson et al.

(Continued)

FOREIGN PATENT DOCUMENTS

WO 2013-055361 A1 4/2013

*Primary Examiner* — Grant Moubry

(57) ABSTRACT

A housing has an outer pipe. An inner pipe is accommodated in the outer pipe. The inner pipe defines an inner passage internally. The inner pipe defines an annular passage externally with the outer pipe. The inner pipe has through holes communicating the inner passage with the annular passage. The housing internally defines an EGR channel communicating with the annular passage. The EGR channel accommodates a deflector partitioning the EGR channel.

18 Claims, 8 Drawing Sheets

(56) References Cited

U.S. PATENT DOCUMENTS

2013/0025576 A1* 1/2013 Busato ..... F02M 26/16
123/568.11

* cited by examiner

EGR DEVICE HAVING DEFLECTOR AND EGR MIXER FOR EGR DEVICE

TECHNICAL FIELD

The present disclosure relates to an EGR device having a deflector for an internal combustion engine of a vehicle. The present disclosure further relates to an EGR mixer for the EGR device.

BACKGROUND

A vehicle may be equipped with an exhaust gas recirculation system (EGR system). The EGR system is to reduce emission contained in exhaust gas discharged from an internal combustion engine. The EGR system may recirculate a part of exhaust gas into fresh air to produce mixture gas containing recirculated exhaust gas and fresh air. Recirculated exhaust gas may be unevenly mixed with fresh air to reduce combustion efficiency of the engine consequently.

SUMMARY

The present disclosure addresses the above-described concerns.

According to an aspect of the preset disclosure, an EGR device comprises a housing having an outer pipe. The EGR device further comprises an inner pipe accommodated in the outer pipe. The inner pipe defines an inner passage internally. The inner pipe defines an annular passage externally with the outer pipe. The inner pipe has a plurality of through holes communicating the inner passage with the annular passage. The housing internally defines an EGR channel communicating with the annular passage. The EGR channel accommodates a deflector partitioning the EGR channel.

According to another aspect of the preset disclosure, an EGR mixer is for an EGR device. The EGR mixer is configured to be accommodated in an outer pipe of a housing of the EGR device to define an annular passage with the outer pipe. The EGR mixer comprises a pipe body defining an inner passage and having a plurality of through holes arranged along a circumferential direction of the pipe body, the through holes communicating the inner passage with the annular passage. The EGR mixer further comprises a deflector accommodated in an EGR channel formed in the housing to partition the EGR channel at an upstream side of the pipe body.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

Figure 1:
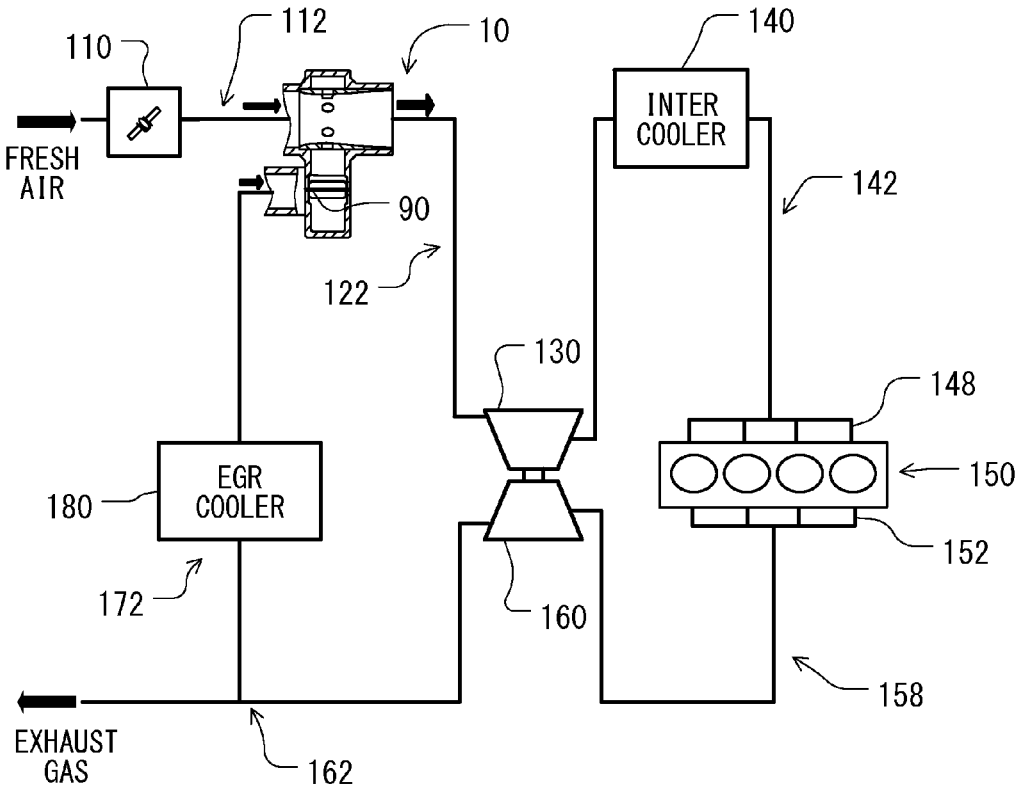
FIG. 1 is a block diagram showing an EGR system for an internal combustion engine of a vehicle.

In the following description, a radial direction is along an arrow represented by "RADIAL" in drawing(s). An axial direction is along an arrow represented by "AXIAL" in drawing(s). A circumferential direction is along an arrow represented by "CIRCUMFERENTIAL" in drawing(s). A vertical direction is along an arrow represented by "VERTICAL" in drawing(s). A horizontal direction is along an arrow represented by "HORIZONTAL" in drawing(s). A flow direction is along an arrow represented by "FLOW" in drawing(s).

As follows, a first embodiment of the present disclosure will be described with reference to FIGS. 1 to 4. As shown FIG. 1, according to the present example, an internal combustion engine 150 has four cylinders connected with an intake manifold 148 and an exhaust manifold 152.

The engine 150 is combined with an intake and exhaust system. The intake and exhaust system includes an intake valve 110, an intake passage 112, an EGR device 10, a mixture passage 122, a turbocharger including a compressor 130 and a turbine 160, a charge air passage 142, and an intercooler 140. The intake and exhaust system further includes a combustion gas passage 158, an exhaust passage 162, an EGR passage 172, and an EGR cooler 180.

The intake passage 112 is equipped with the intake valve 110. The intake passage 112 is connected with the EGR device 10. The EGR device 10 is connected with the compressor 130 through the mixture passage 122. The compressor 130 is connected with the intake manifold 148 through the charge air passage 142. The charge air passage 142 is equipped with the intercooler 140. The exhaust manifold 152 is connected with the turbine 160 through the combustion gas passage 158. The turbine 160 is connected with the exhaust passage 162. The EGR passage 172 is branched from the exhaust passage 162 and connected with the EGR device 10. The EGR passage 172 is equipped with the EGR cooler 180.

The intake passage 112 conducts fresh air from the outside of the vehicle through the intake valve 110 into the EGR device 10. The intake valve 110 regulates a quantity of fresh air flowing through the intake passage 112 into the EGR device 10. The EGR device 10 draws fresh air from the intake passage 112 and draws exhaust gas from the exhaust passage 162 through the EGR passage 172. The EGR device 10 includes an EGR mixer to blend the drawn fresh air with the drawn exhaust gas to produce mixture gas. The mixture passage 122 conducts the mixture gas from the EGR device 10 into the compressor 130.

The compressor 130 is rotatably connected with the turbine 160 via a common axis. The compressor 130 is driven by the turbine 160 to compress the mixture gas. The charge air passage 142 conducts the compressed mixture gas to the intake manifold 148. The intercooler 140 is a heat exchanger to cool the compressed mixture gas conducted through the charge air passage 142.

The engine 150 draws the cooled mixture gas. The engine 150 forms air-fuel mixture with the drawn mixture gas and injected fuel in each cylinder and burns the air-fuel mixture in the cylinder to drive a piston in the cylinder. The engine 150 emits combustion gas (exhaust gas) through the exhaust manifold 152 into the combustion gas passage 158. The combustion gas passage 158 conducts the combustion gas into the turbine 160. The turbine 160 is driven by the exhaust gas to drive the compressor 130 thereby to cause the compressor 130 to compress mixture gas and to press-feed the compressed mixture gas through the charge air passage 142 and the intercooler 140 into the engine 150.

The exhaust passage 162 conducts exhaust gas (combustion gas) from the turbine 160 to the outside of the vehicle. The EGR passage 172 is branched from the exhaust passage 162 at the downstream side of the turbine 160 to recirculate a part of exhaust gas from the exhaust passage 162 into the EGR device 10. The EGR cooler 180 is a heat exchanger to cool exhaust gas flowing though the EGR passage 172 into the EGR device 10. The EGR device 10 is located at a connection among the intake passage 112, the EGR passage 172, and the mixture passage 122. The EGR passage 172 is merged with the intake passage 112 in the EGR device 10. The EGR device 10 includes an EGR valve 90 to regulate a quantity of EGR gas recirculated into the EGR mixer.

As described above, the EGR system is configured to recirculate a part of exhaust gas from the exhaust passage 162 into the intake passage 112. The circulated exhaust gas may contain oxygen at a lower percentage compared with oxygen contained in fresh air. Therefore, circulated exhaust gas may dilute mixture of exhaust gas and fresh air thereby to reduce peak temperature of combustion gas when burned in the combustion chamber of the engine 150. In this way, the EGR system may reduce oxidization of nitrogen, which is caused under high temperature, thereby to reduce nitrogen oxide (NOx) occurring in the combustion chamber.

Figure 2:
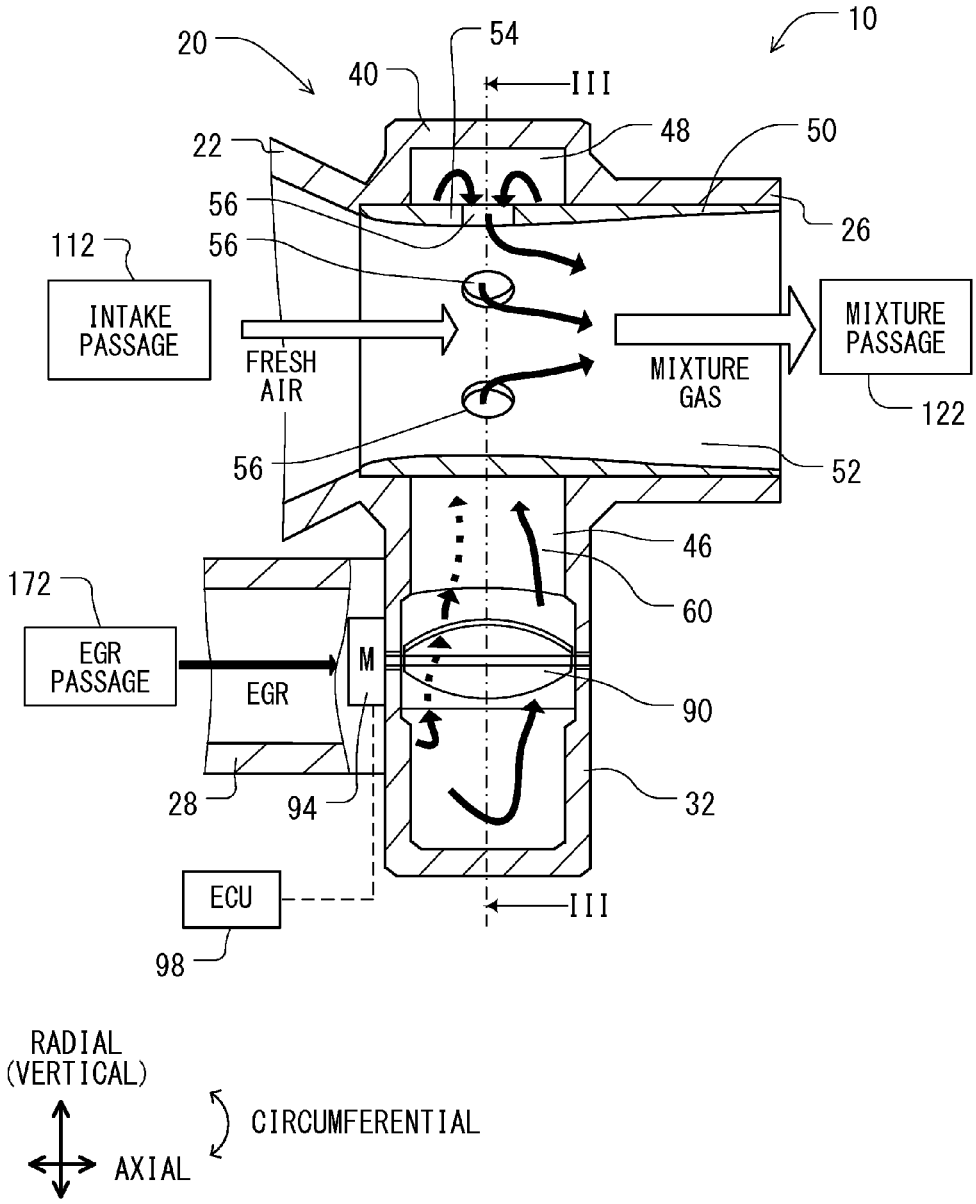
FIG. 2 is a sectional view showing an EGR device for the EGR system, according to a first embodiment.
Figure 3:
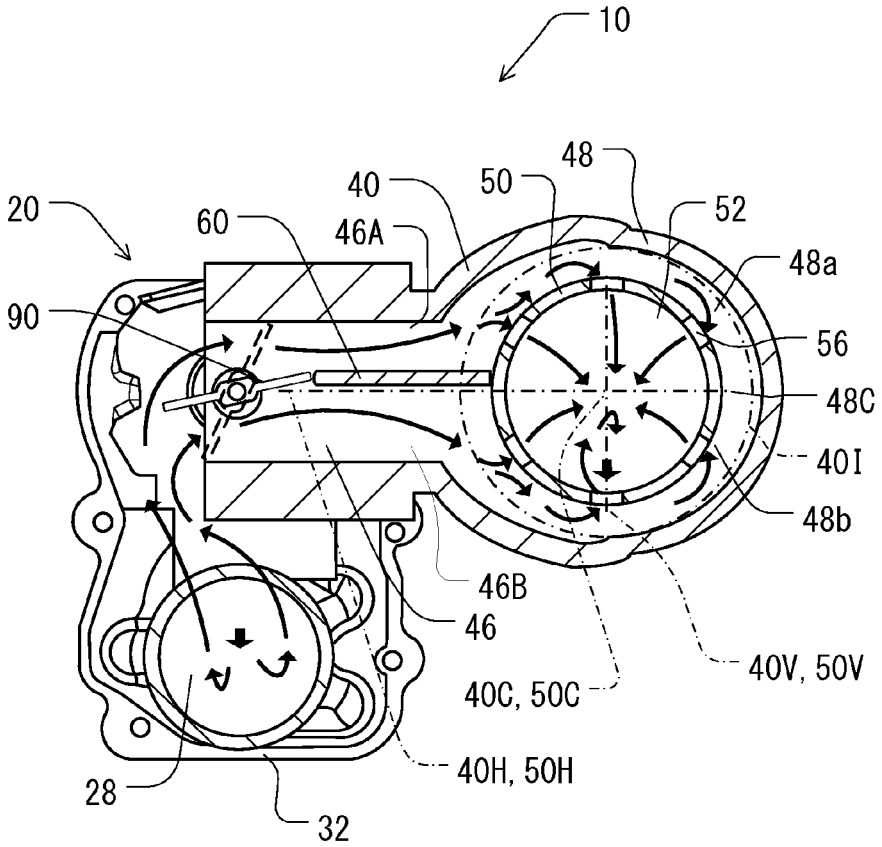
FIG. 3 is a sectional view showing the EGR device, the sectional view corresponding to a section taken along the line III-III in FIG. 2.
Figure 3:
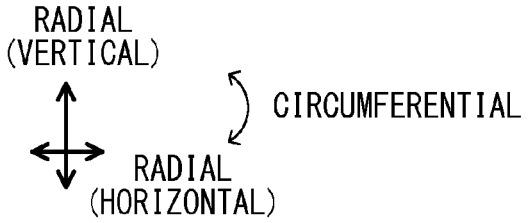
Figure 4:
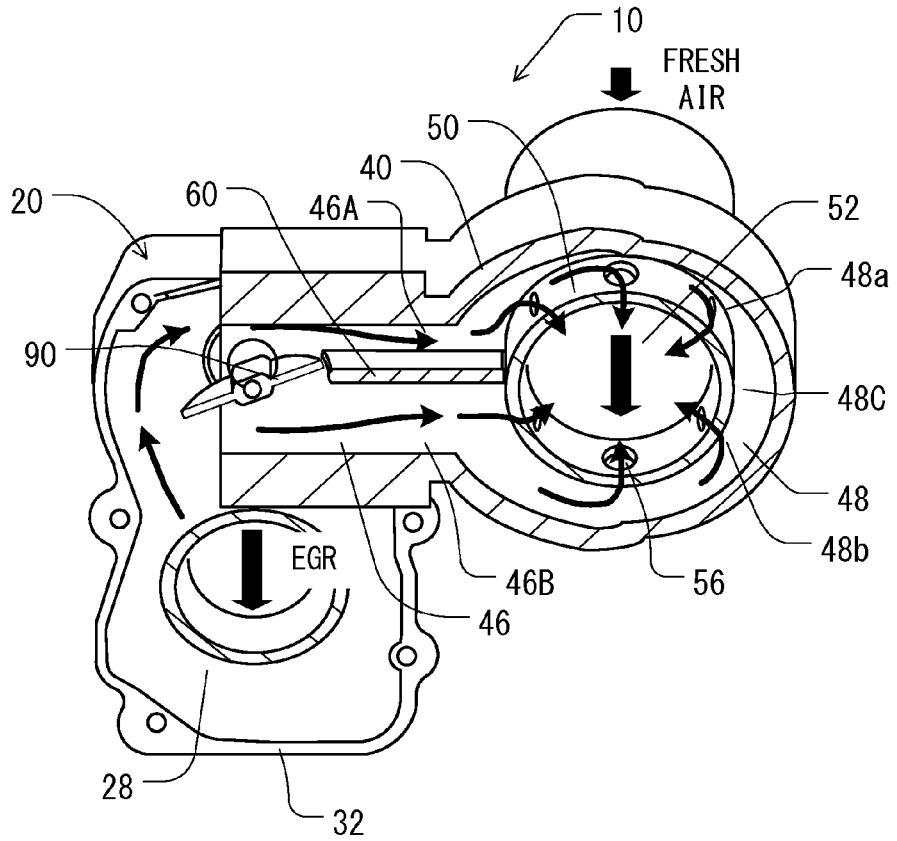
FIG. 4 is a perspective sectional view showing the EGR device.
Figure 4:
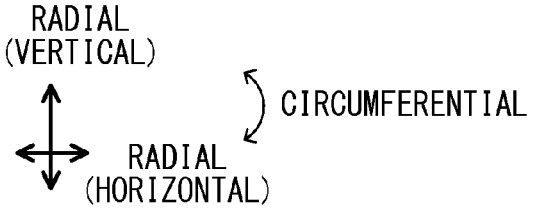

Subsequently, the configuration of the EGR device 10 will be described in detail. As shown in FIGS. 2 to 4, the EGR device 10 includes a housing 20 accommodating an inner pipe (EGR mixer, pipe body) 50, the EGR valve 90, and a motor 94. The housing 20, the inner pipe 50, and the EGR valve 90 are formed of a metallic material such as stainless steel and/or an aluminum alloy.

The housing 20 includes an air inlet 22, an outer pipe 40, an outlet 26, an EGR inlet 28, and an EGR guide 32. The air inlet 22 is connected with the intake passage 112. The outlet 26 is connected with the mixture passage 122. The outer pipe 40 is located between the air inlet 22 and the outlet 26. The outer pipe 40 is greater than both the air inlet 22 and the outlet 26 in inner diameter to form an annular groove extending in the circumferential direction.

The inner pipe 50 is in a tubular shape and is inserted in the housing 20. The inner pipe 50 is affixed to the housing 20 by, for example, welding. The inner pipe 50 has an outer periphery, which defines an annular passage 48 with an inner periphery of the outer pipe 40. The annular passage 48 extends in the circumferential direction. The inner pipe 50 has an inner periphery, which defines an inner passage 52 communicated with the intake passage 112 and the mixture passage 122. The inner pipe 50 has an inner periphery defining a curvature to reduce the inner passage 52 at an intermediate portion 54 in the axial direction. The intermediate portion 54 forms a throttle radially inward.

The inner pipe 50 has multiple through holes 56, which are arranged along the circumferential direction. According to the present example, the inner pipe 50 has five through holes 56, which are arranged substantially at angular intervals, such as 60-degree intervals. Each of the through holes 56 extends along the radial direction through an inner wall of the inner pipe 50. The through hole 56 is directed substantially at 90 degrees relative to a center axis of the inner pipe 50.

The EGR inlet 28 is connected with the EGR passage 172. The EGR inlet 28 is communicated with an EGR channel 46 defined in the EGR guide 32. The EGR channel 46 is configured to be communicated with the annular passage 48.

The EGR valve 90 is, for example, a butterfly valve having a shaft, which is rotatably supported by bearings at both ends. Thus, the EGR valve 90 is rotatably equipped in the EGR guide 32 and is variable in rotational position to control an opening area of the EGR channel 46. The EGR valve 90 is rotatable between a full close position and a full open position. The EGR valve 90 is at the full close position when being at the position represented by dotted line in FIG. 3. The motor 94 (FIG. 2) is equipped to one end of the shaft to drive the EGR valve 90. An electronic control unit (ECU) 98 is electrically connected with the motor 94 to control electricity supplied to the motor 94 thereby to control the rotation angle of the valve. The motor 94 may be equipped with a hall sensor (not shown) to detect the rotation angle and to send a signal representing the detected rotation angle to the ECU 98.

The EGR channel 46 accommodates a deflector 60 on the upstream side of the annular passage 48 relative to the flow of EGR gas. The deflector 60 is substantially in a plate shape and is formed of a metallic material such as stainless steel and/or an aluminum alloy. The deflector 60 is affixed to an inner periphery of the EGR channel 46, by for example, welding. The deflector 60 may be a separate component from the inner pipe 50.

In FIG. 3, the deflector 60 extends in parallel with a center axis (horizontal center) 40H of the outer pipe 40, a center axis (horizontal center) 50H of the inner pipe 50, a center axis of the EGR channel 46, and the radial direction of the inner pipe 50. The deflector 60 extends perpendicularly to the axial direction of the inner pipe 50 through the EGR channel 46 and extends perpendicularly to the outer periphery of the inner pipe 50.

The deflector 60 closes off a passage area of the EGR channel 46 between the EGR valve 90 and the inner pipe 50. The deflector 60 substantially partitions the EGR channel 46 into an upper channel (first channel) 46A and a lower channel (second channel) 46B.

The deflector 60 further partitions the annular passage 48 into an upper arc passage (first arc passage) 48A and a lower arc passage (second arc passage) 48B at one end (root end). The upper channel 46A communicates with the upper arc passage 48A. The lower channel 46B communicates with the lower arc passage 48B. The upper channel 46A and the lower channel 46B ultimately communicate with each other through the upper arc passage 48A and the lower arc passage 48B at a boundary 48C between the upper arc passage 48A and the lower arc passage 48B. The boundary 48C is located at the opposite side of the inner pipe 50 from the deflector 60. The deflector 60 partitions the annular passage at the opposite side of the inner pipe 50 from the boundary 48*c*.

As shown by the arrows in FIG. 3, EGR gas passes around the EGR valve 90 and further flows along the deflector 60. Thus, the deflector 60 may deflect the flow of EGR gas to flow around the outer periphery of the inner pipe 50 through the annular passage 48.

The present configuration enables to flow EGR gas from the EGR passage 172 to pass around the EGR valve 90 and to pass through the upper channel 46A or the lower channel 46B of the EGR channel 46. The present configuration further enables to flow EGR gas to pass through the upper arc passage 48A and the lower arc passage 48B of the annular passage 48 circumferentially and further to flow the EGR gas into the inner passage 52 radially inward through the through holes 56. The annular passage 48 leads EGR gas to flow from the EGR channel 46 and to flow entirely around the outer periphery of the inner pipe 50 toward the opposite side of the EGR channel 46. Thus, the annular passage 48 may enable to distribute EGR gas evenly around the inner pipe 50 in the circumferential direction. The ECU 98 is configured to control the position of the EGR valve 90 to manipulate a quantity of EGR gas flowing through the EGR channel 46 into the annular passage 48.

In FIG. 2, the curvature defined by the inner periphery of the inner pipe 50 may be configured to throttle the inner passage 52 and to cause Venturi effect at the intermediate portion 54. The curvature may be configured to increase flow velocity of fresh air and to cause negative pressure at the intermediate portion 54. Thus, the curvature may facilitate to induce EGR gas from the annular passage 48 on the radially outside of the inner pipe 50 into the inner passage 52 through the through holes 56. In this way, the curvature may facilitate to feed EGR gas into the inner passage 52 and to blend the EGR gas with fresh air.

The inner pipe 50 has a cross section having a vertical center 50V, the horizontal center 50H, and a center point 50C, which is an intersection between the vertical center 50V and the horizontal center 50H. The inner periphery of the outer pipe 40 has a cross section defining an inscribe circle 401, which has a vertical center 40V, the horizontal center 40H, and a center point 40C, which is an intersection between the vertical center 40V and the horizontal center 40H.

In the present example, as shown in FIG. 3, the inner pipe 50 and the outer pipe 40 are substantially coaxial with each other. Specifically, the center point 50C of the inner pipe 50 and the center point 40C of the inscribe circle 401 of the outer pipe 40 substantially coincide with each other.

The through holes 56 extends from the annular passage 48 toward the inner passage 52 to throttle EGR gas flowing from the through holes 56. The present configuration enables to flow EGR gas from the outside of the inner pipe 50 through the through holes 56 into the inner passage 52. After passing through the through holes 56, EGR gas may be expanded and diffused into fresh air passing through the inner passage 52. Thus, the present configuration may enable EGR gas to be homogeneously and evenly blended with fresh air in the inner passage 52 to produce uniform mixture gas.

The deflector 60 may restrict a stream line of EGR gas from passing across the horizontal centers 40H and 50H. That is, the deflector 60 may restrict EGR gas from flowing from the lower channel 46B into the upper channel 46A and may restrict EGR gas from flowing from the upper channel 46A into the lower channel 46B. In this way, the deflector 60 may rectify stream lines of EGR gas to extend horizontally within the upper channel 46A or the lower channel 46B thereby to extend selectively into the upper arc passage 48*a* or the lower arc passage 48*b*. Thus, the deflector 60 may rectify EGR gas to flow smoothly along the outer periphery of the inner pipe 50. The deflector 60 may enable the streamlines of EGR gas to extend further toward the boundary 48*c* of the annular passage 48 on the opposite side of the EGR channel 46. That is, the deflector 60 may enable EGR gas to access the opposite side of the EGR channel 46 across the inner pipe 50.

In FIG. 3, the solid line represents the EGR valve 90 substantially at a full open position. When the EGR valve 90 is substantially at the full open position, the EGR valve 90 may be continuously positioned with the deflector 60 to form extended passages on the upper side and the lower side in the drawing to be respectively communicated with the upper channel 46A and the lower channel 46B continuously. Thus, the EGR valve 90 and the deflector 60 may form elongated passages to linearly rectify stream lines of EGR gas toward the boundary 48C across the inner pipe 50.

In the present example, the deflector 60 is offset from the horizontal centers 40H and 50H upward in the vertical direction. That is, the deflector 60 is offset from the center of the EGR channel 46. The deflector 60 defines the upper channel 46A and the lower channel 46B, such that the passage area of the upper channel 46A is less than the passage area of the lower channel 46B.

Second Embodiment

Figure 5:
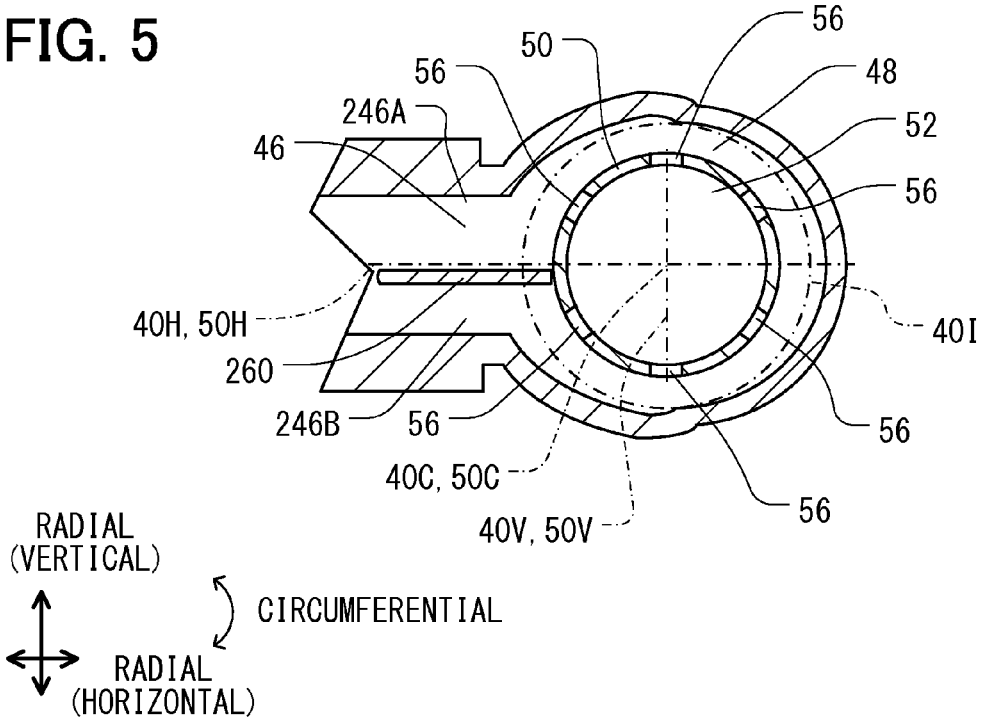
FIGS. 5 to 7 are sectional views showing an EGR device according to second to fourth embodiments.

As shown in FIG. 5, according to the present second embodiment, the deflector 60 is offset from the horizontal centers 40H and 50H downward in the vertical direction. The deflector 60 defines an upper channel 246A and a lower channel 246B, such that the passage area of the upper channel 246A is greater than the passage area of the lower channel 246B.

Third Embodiment

Figure 6:
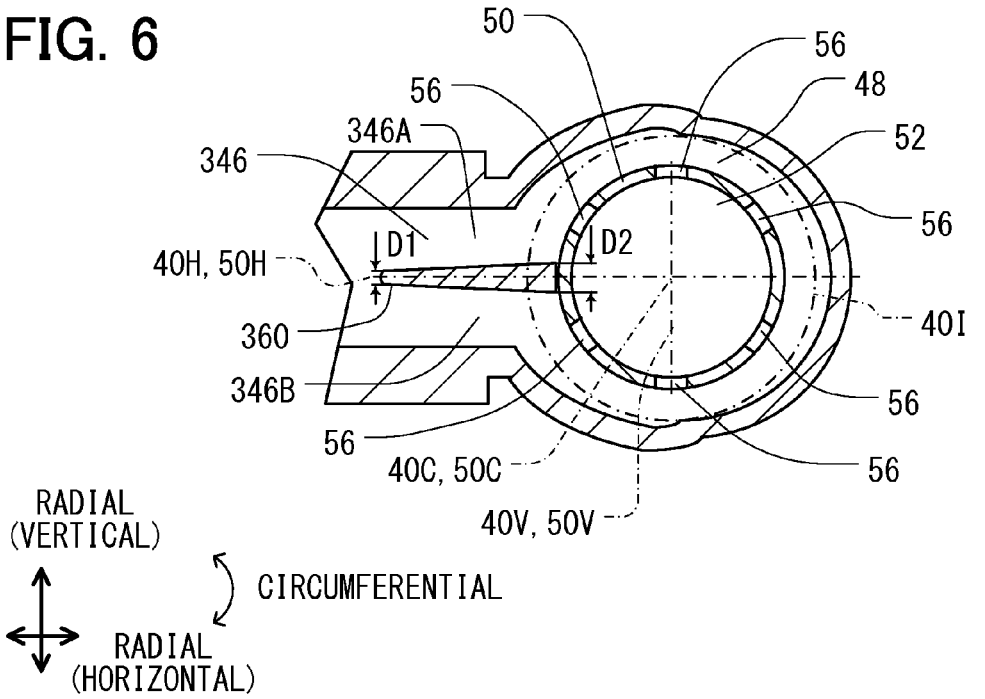

As shown in FIG. 6, according to the present third embodiment, a deflector 360 is located along the horizontal centers 40H and 50H to extend along the horizontal direction. The deflector 360 defines an EGR channel 346 including an upper channel 346A and a lower channel 346B. The upper channel 246A and the lower channel 246B may be substantially symmetric to each other relative to the horizontal centers 40H and 50H.

The deflector 360 has a root end and a tip end. The root end is adjacent to the inner pipe 50. The tip end is located on the opposite side of the deflector 60 from the root end. The deflector 360 has the tip end having a width D1 and the root end having a width D2, such that the widths D1 and D2 substantially satisfy the following relation: $D2=2\times D1$. The deflector 360 increases in cross section from the tip end toward the root end. The upper channel 346A and the lower channel 346B extend from the tip end of the deflector 360 toward the root end of the deflector 360 to be inclined outward relative to the horizontal centers 40H and 50H.

The deflector 360 may direct the upper channel 346A and the lower channel 346B radially outward smoothly toward the outer periphery of the inner pipe 50.

Fourth Embodiment

Figure 7:
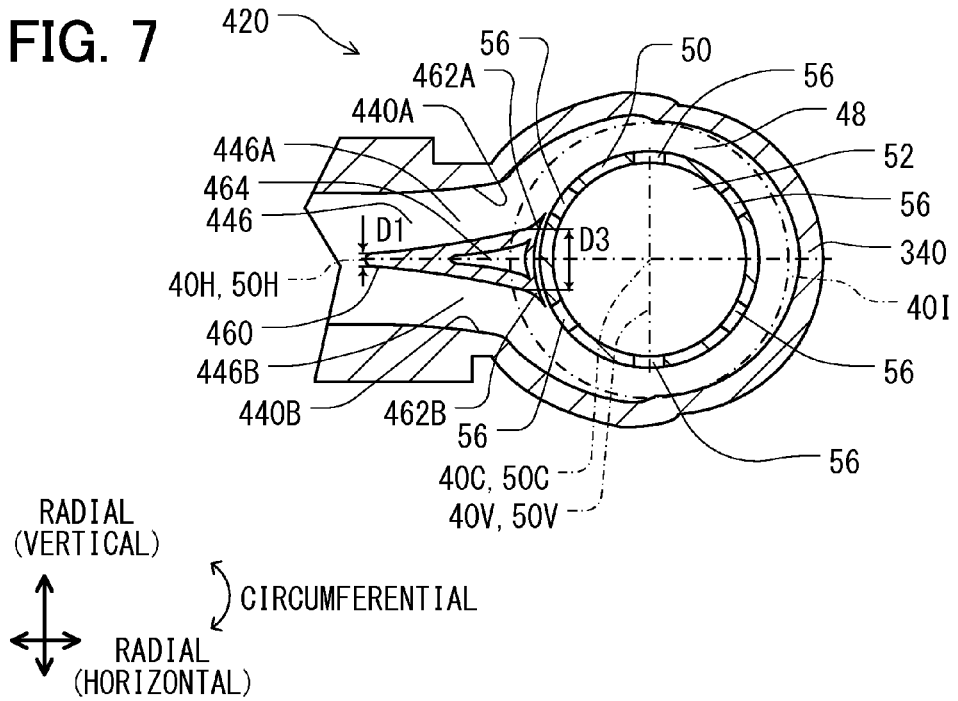

As shown in FIG. 7, according to the present fourth embodiment, a deflector 460 is located along the horizontal centers 40H and 50H to extend along the horizontal direction. The deflector 460 defines an EGR channel 446 including an upper channel 446A and a lower channel 446B. The upper channel 246A and the lower channel 246B may be substantially symmetric to each other relative to the horizontal centers 40H and 50H.

The deflector 460 has a tip end having a width D1 and a root end having a width D3, such that the widths D1 and D3 substantially satisfy the following relation: $D3=6\times D1$. That is, the widths D1 and D3 satisfy the following relation: $D3>>D1$. The cross section of the deflector 460 increases from the tip end toward the root end. The root end of the deflector 460 has curved ends 462A and 462B extending outward from the root end smoothly toward the outer periphery of the inner pipe 50. The deflector 460 has a hollow 464 substantially at the center.

A housing 420 defines an upper curvature 440A on the upper side of the upper channel 446A and defines a lower curvature 440B on the lower side of the lower channel 446B. The curvatures 440A and 440B may extend outward relative to the horizontal centers 40H and 50H and may extend substantially along the outer periphery of the deflector 460.

The upper curvature 440A and the deflector 460 form the upper channel 446A directed from the tip end of the deflector 460 toward the root end of the deflector 460 smoothly toward the annular passage 48. The lower curvature 440B and the deflector 460 form the lower channel 446B directed from the tip end of the deflector 460 toward the root end of the deflector 460 smoothly toward the annular passage 48. The curved ends 462A and 462B may connect the upper channel 446A and the lower channel 446B smoothly toward the annular passage 48.

Fifth Embodiment

Figure 8:
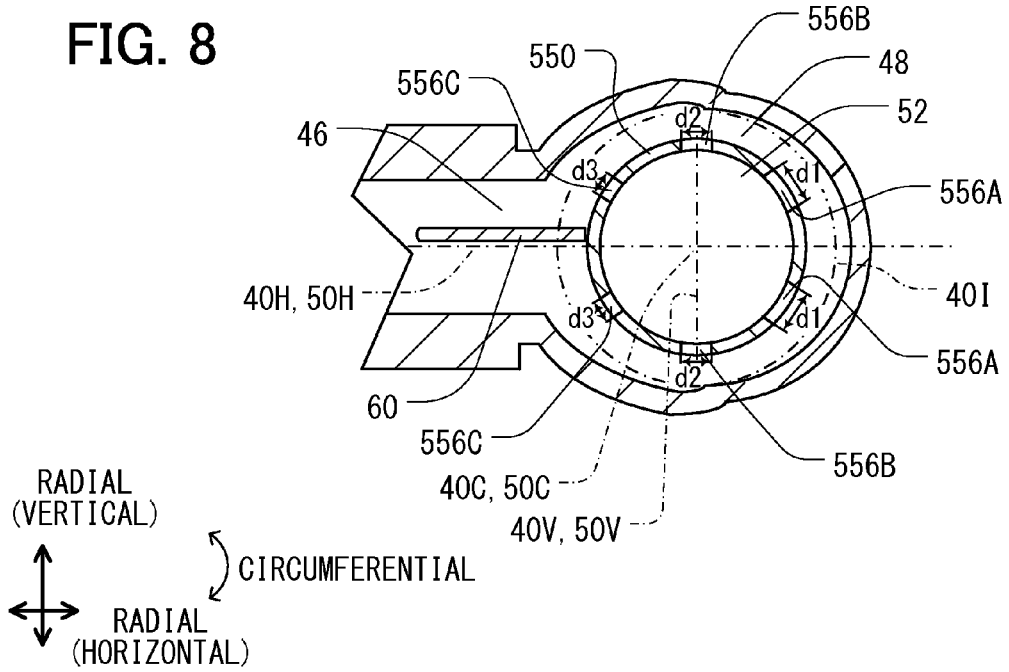
FIGS. 8 to 9 are sectional views showing an EGR device according to fifth to sixth embodiments.

As shown in FIG. 8, according to the present fifth embodiment, an inner pipe 550 has through holes, which have different diameters. Specifically, through holes 556A, 556B, 556C are formed to have diameters increased from the side of the EGR channel 46 toward the opposite side of the EGR channel 46. More specifically, the through holes 556A have an inner diameter d1. The through holes 556B have an inner diameter d2. The through holes 556C have an inner diameter d3. The diameters d1, d2, d3 satisfy the following relation: d1>d2>d3. In the present example, similarly to the first embodiment, the inner pipe 550, and the outer pipe 40 are substantially coaxial with each other.

Sixth Embodiment

Figure 9:
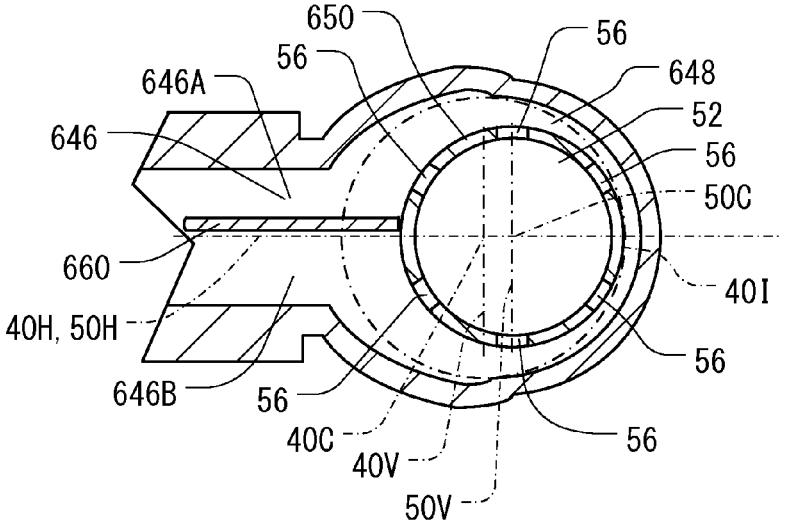
Figure 9:
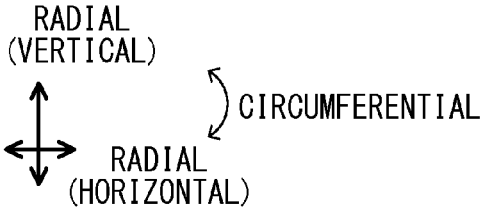

As shown in FIG. 9, according to the present sixth embodiment, an inner pipe 650 is offset relative to the outer pipe 40, such that the vertical center 40V of the outer pipe 40 is offset from the vertical center 50V of the inner pipe 50 in the radial direction. More specifically, the outer pipe 40 and the inner pipe 50 may be offset in relation to each other so that a distance between the outer pipe 40 and the inner pipe 50 progressively decreases from the EGR channel 46 to the opposite side of the EGR channel 46. Therefore, an annular passage 648 formed between the outer pipe 40 and the inner pipe 650 is gradually reduced in passage area toward the opposite side of the EGR channel 46.

In the present sixth embodiment, a deflector 660 extends from the inner pipe 50 through an EGR passage 646. The deflector 660 may be greater in length than the deflector 60 according to the first embodiment. The deflector 660 may form an upper channel 646A and a lower channel 646B in the EGR passage 646. The upper channel 646A and the lower channel 646B may be greater in length than the upper channel 46A and the lower channel 46B according to the first embodiment.

Seventh Embodiment

Figure 10:
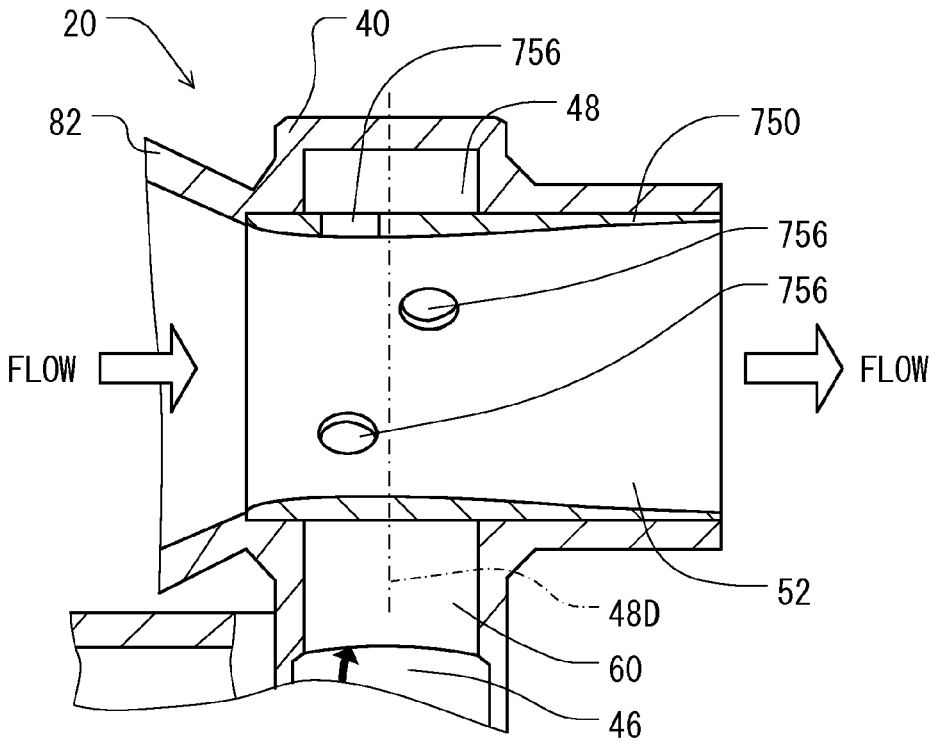
FIG. 10 is a sectional view showing an EGR device according to a seventh embodiment.
Figure 10:
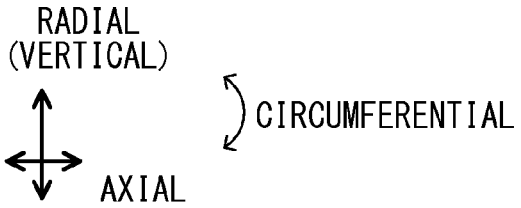

In FIG. 10, bold arrows show the flow of fresh air on the upstream side and the flow of mixture gas on the downstream side. According to the present seventh embodiment, in FIG. 10, which is the sectional view, an inner pipe 750 has two through holes 756 on the upstream side of a centerline 48D of the annular passage 48 and one through hole 756 on the downstream side of the centerline 48D of the annular passage 48. That is, in the entire circumferential direction, three through holes 756 are arranged on the upstream side in total, and two through holes 756 are arranged on the downstream side in total. In the present configuration, the through holes 756 are arranged alternately in the circumferential direction. That is, the through holes 756 are arranged alternately relative to the axial direction of the inner pipe 50.

Other Embodiment

The deflector may be located on the horizontal center. The deflector may be in an arc shape. In this case, the deflector may form an upper channel and a lower channel to have curved passages. The deflector may be inclined relative to the horizontal center. In this case, the deflector may form an upper channel and a lower channel to have inclined passages. The deflector may be integrally formed with the inner pipe.

Various combinations of the deflector, the inner pipe, and other components of the EGR device according to the above-described embodiments may be arbitrary employed.

The through holes may employ various forms. For example, the through holes may employ various numbers, various sizes, various arrangements, and/or various shapes. For example, the through holes may employ various shapes such as an oval shape, a polygonal shape, or a star shape. Various combinations of the through holes of the above-described embodiments may be arbitrary employed.

The through holes may be unevenly arranged. For example, the through holes may be concentrically formed on the opposite side of the EGR channel.

The through hole(s) on the side of the EGR channel may be omitted. The inner pipe may not have the curvature on the inner periphery.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An EGR device comprising:

a housing having an upstream side communicating with an intake passage, and a downstream side communicating with a mixture passage, having an outer pipe; and an inner pipe accommodated in the outer pipe, wherein the inner pipe defines an inner passage internally, the inner pipe defines an annular passage externally with the outer pipe, the inner pipe has a plurality of through holes communicating the inner passage with the annular passage, the housing internally defines an EGR channel communicating with the annular passage, and the EGR channel accommodates a deflector partitioning the EGR channel.

2. The EGR device according to claim 1, wherein the through holes are arranged along a circumferential direction of the inner pipe.

3. The EGR device according to claim 1, wherein the deflector is in a plate shape.

4. The EGR device according to claim 3, wherein the deflector extends perpendicularly to an axial direction of the inner pipe through the EGR channel.

5. The EGR device according to claim 3, wherein the deflector extends perpendicularly to an outer periphery of the inner pipe.

6. The EGR device according to claim 3, wherein
the deflector extends in parallel with the EGR channel, and
the deflector extends in parallel with a radial direction of the inner pipe.

7. The EGR device according to claim 1, wherein the first channel and the second channel communicate with each other at a boundary between the first arc passage and the second arc passage, and the boundary is located at an opposite side of the inner pipe from the deflector.

8. The EGR device according to claim 7, wherein
the deflector partitions the annular passage at an opposite side of the inner pipe from the boundary.

9. The EGR device according to claim 1, further comprising:
an EGR valve rotatable in the EGR channel, wherein
the EGR valve is configured to form extended passages with the deflector,
the extended passages continuously extend to the first channel and the second channel, respectively.

10. The EGR device according to claim 1, wherein the deflector is located on an upstream side of the annular passage.

11. The EGR device according to claim 1, wherein the deflector is offset from a center of the EGR channel.

12. The EGR device according to claim 1, wherein
the deflector has a tip end and a root end,
the root end is adjacent to the inner pipe,
the tip end is located on an opposite side of the deflector from the root end, and
the deflector increases in cross section from the tip end toward the root end.

13. The EGR device according to claim 1, wherein
the inner pipe has an inner periphery defining a curvature, and
the inner pipe has an intermediate portion projected radially inward to throttle the inner passage.

14. The EGR device according to claim 13, wherein the through holes are located at the intermediate portion.

15. The EGR device according to claim 1, wherein at least one of the through holes on the upstream side is smaller than at least one of an other of the through holes.

16. The EGR device according to claim 1, wherein the inner pipe is offset from the outer pipe in a radial direction.

17. The EGR device according to claim 1, wherein the through holes are arranged alternately in a circumferential direction of the inner pipe.

18. The EGR device according to claim 1, wherein
the inner passage is configured to flow air,
the EGR channel is configured to flow EGR gas, and
the inner passage is configured to mix EGR gas with air to forma mixture of EGR gas and air.

* * * * *